United States Patent [19]

Vaughn

[11] 4,338,916

[45] Jul. 13, 1982

[54] FIRE DOG

[76] Inventor: John F. Vaughn, P.O. Box 512, Saluda, S.C. 29138

[21] Appl. No.: 245,605

[22] Filed: Mar. 19, 1981

Related U.S. Application Data

[63] Continuation-in-part of Ser. No. 105,375, Mar. 20, 1980, abandoned.

[51] Int. Cl.[3] ..... F24B 13/00

[52] U.S. Cl. ..... 126/298; 126/164; 126/202

[58] Field of Search ..... 126/298, 201, 202, 203, 126/164, 165, 152 B; 248/165

[56] References Cited

U.S. PATENT DOCUMENTS

| | | | |
|---|---|---|---|
| 1,261,068 | 4/1918 | Tatum | 126/164 |
| 1,347,935 | 7/1920 | Campbell | 126/298 |
| 1,430,488 | 9/1922 | Board | 126/202 |
| 1,683,420 | 9/1928 | Skube, Jr. | 126/298 |
| 1,684,749 | 9/1928 | Theobalds | 126/164 |
| 2,593,077 | 4/1952 | Vogt | 248/165 |
| 2,600,753 | 6/1952 | Gilbert | 126/298 |
| 2,985,165 | 5/1961 | Peterson et al. | 126/164 |
| 3,771,511 | 11/1973 | Dahlquist | 126/165 |
| 4,058,108 | 11/1977 | Dahlquist | 126/165 |

FOREIGN PATENT DOCUMENTS

| | | | |
|---|---|---|---|
| 858882 | 12/1952 | Fed. Rep. of Germany | 126/165 |

*Primary Examiner*—James C. Yeung

*Attorney, Agent, or Firm*—Cushman, Darby & Cushman

[57] ABSTRACT

A fire dog for preventing logs from rolling out of a fireplace or stove includes a generally planar front member against which logs may rest, legs attached to the front member to keep the front member vertical, and a handle which is removably attached to the front member. The legs are designed to slide under conventional grates. The front member is designed to aid in creating an even burning fire.

9 Claims, 3 Drawing Figures

FIRE DOG

This is a continuation-in-part of Ser. No. 105,375, filed Mar. 20, 1980, which is abandoned upon filing of this application.

BACKGROUND OF THE INVENTION

1. Field of the Invention

The present invention relates to safety devices employable with wood burning devices. More specifically, the present invention relates to devices for maintaining burning logs within a fireplace, stove or the like.

2. Description of the Prior Art

Hazards associated with wood burning devices have existed as long as the devices themselves. The problems have only recently become more poignant because of the increased use of wood burning devices due to the soaring costs of petrochemical fuels and electricity. This, coupled with the relative lack of experience of new users, has produced numerous disasters.

Obviously, the amount of heat that can be produced by a fireplace or a stove is related to the amount of wood that is burning within the stove or fireplace, and thus, a great deal of wood is commonly piled into the fireplace or stove. However, the wood in a stove may not be stable, particularly as the lower logs burn, thus eliminating support for the upper logs. This may cause the upper logs to roll, perhaps out of the fireplace or stove. This hazardous occurrence has caused the destruction of numerous residences.

A number of fire dogs have been invented to keep wood and/or coal from rolling out of a fireplace or stove as evidenced by the following U.S. Pat. Nos. 1,261,068 to Tatum; 1,347,935 to Campbell; 1,684,749 to Theobalds; 2,600,753 to Gilbert; 2,985,165 to Peterson et al.; and 3,771,511 and 4,058,108 to Dahlquist. Although the fire dogs disclosed in all of these patents will maintain burning logs or coal within the fireplace or stove, there is a drawback with all of these devices. Specifically, the fire dogs are attached to the grate upon which the logs are laid. It is impossible to easily separate the fire dogs from the grate while a fire is burning. Although the fire dogs assist in maintaining the logs within the fireplace or stove, they also make it difficult to insert new logs or remove ashes, or even adjust the position of the burning logs while a fire is in progress.

SUMMARY OF THE INVENTION

The present invention consists of three primary elements—a front member against which logs may rest, legs attached to the front member to keep the front member vertical, and a handle which is removably attached to the front member. The legs are designed to slide under conventional grates. Thus, while the fire is in progress, the present invention may be removed to aid in rearranging the burning logs, adding new logs or removing ashes.

Once the present invention is in place, the handle may be removed so that the present invention may be used in fireplaces or stoves where there is little clearance between the grate and the front screen or door. Alternatively, the handle may be left in place while a fire is burning. The handle extends to the level of the lower edge of the front member, so that when the handle is in place, it provides further support for the front member. Also, as will be discussed below, the handle is shaped so as to maximize the stability of the unit while it is in place, and at the same time provide a convenient place to grasp the invention.

The front member has a plurality of vertical rods which tend to distribute the heat evenly within the fireplace or stove, thus causing the logs within to burn evenly. Also, the outer rods slope inwardly as they approach bottom, thus assisting in holding the hot coals up so that the wood burns evenly, instead of collapsing in the middle. Since logs can be piled nearly vertically along the front member, the flow of air through the damper of the fireplace or stove can be controlled to provide for more even burning. That is, instead of air entering the fire from one direction, such as from underneath the grate, thus creating a hot spot near where the air is entering, air can enter the area where the logs are actually burning from the front also, thus providing for more even and hotter burning.

Finally, when the present invention is not being employed to maintain logs within the fireplace, it may be used to store logs off of a flat surface.

BRIEF DESCRIPTION OF THE DRAWINGS

These and other objects and advantages of the present invention will be more readily apparent and more readily appreciated from the following detailed description of the presently preferred exemplary embodiment of the invention, taken in conjunction with the accompanying drawing, of which.

DETAILED DESCRIPTION OF THE PREFERRED EMBODIMENT

Figure 1:
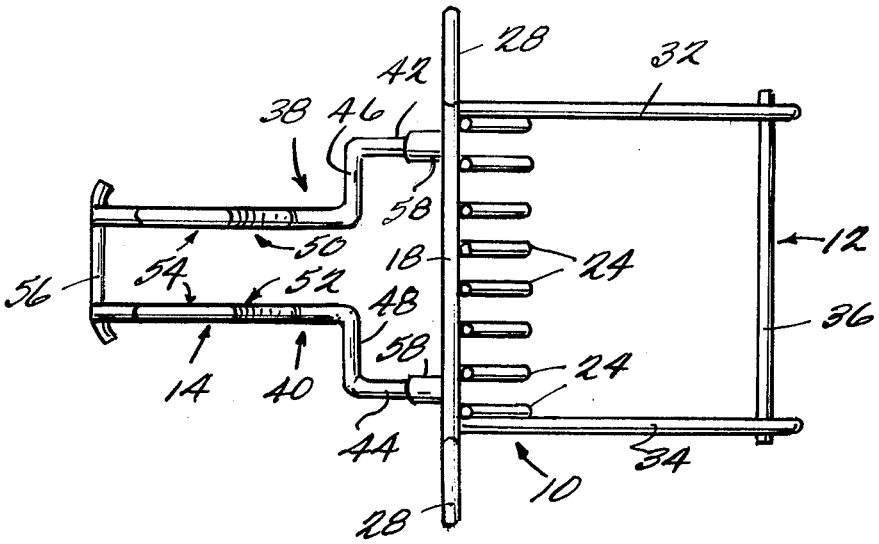
FIG. 1 is a top plan view of the present invention.
Figure 2:
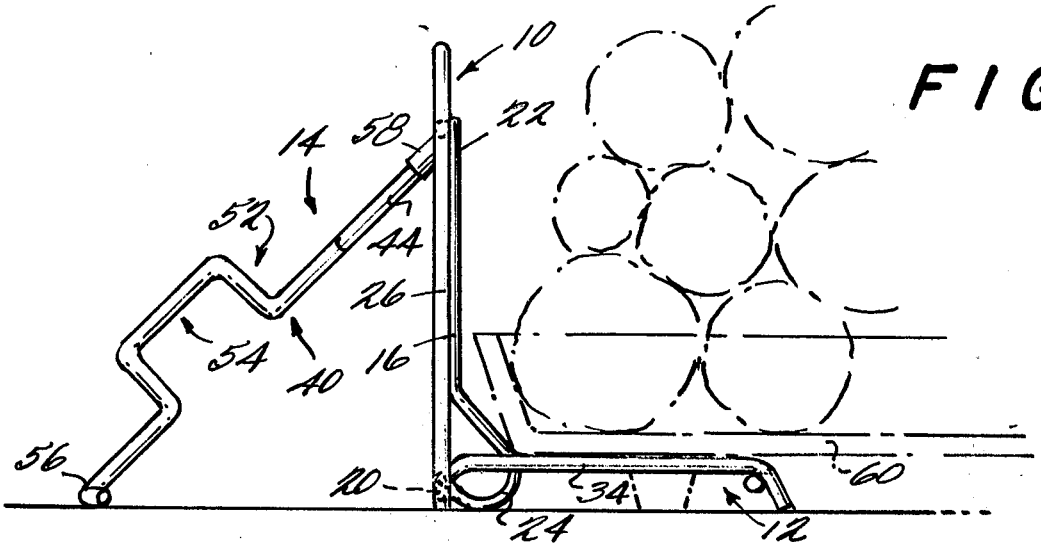
FIG. 2 is a side elevation of the present invention with a grate and logs (not portions of the invention) shown in phantom.
Figure 3:
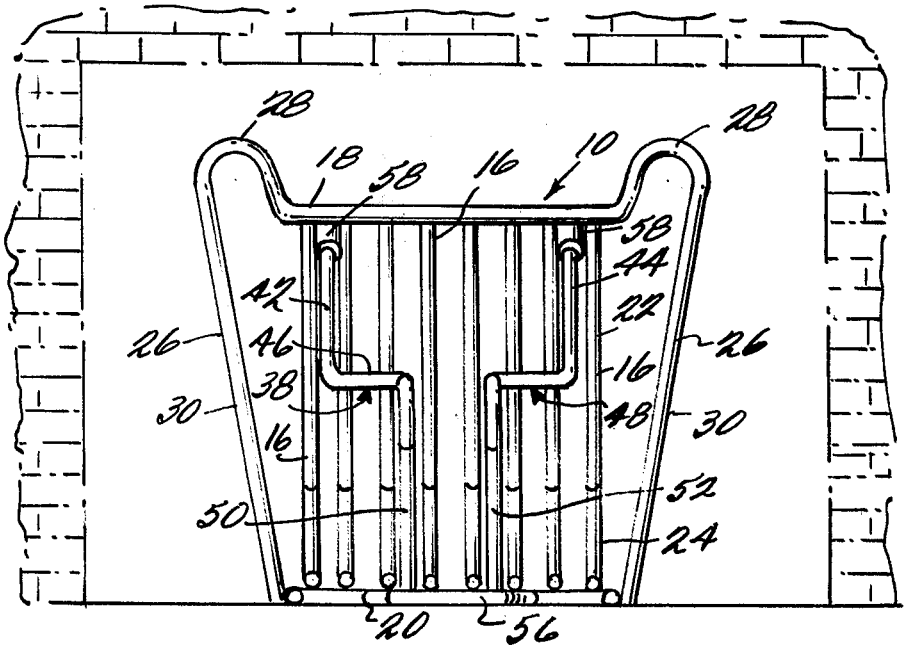
FIG. 3 is a front elevation view of the present invention.

Referring now to the drawing, the present invention includes front member 10, leg assembly 12 and handle 14. As best shown in FIG. 3, front member 10 includes a plurality of vertical members 16 connected between an upper supporting member 18 and a lower supporting member 20. In the preferred embodiment, vertical members 16 are spaced 2 inches apart and are 11½ inches long. Members 18 and 20 are each 18 inches long in the preferred embodiment. As best illustrated in FIG. 2, each vertical member 16 includes a straight portion 22 which is attached to upper support 18 and a portion 24 which is curved inwardly towards leg assembly 12 and attached to lower support 20.

As best illustrated in FIG. 3, at corresponding ends of supports 18 and 20, curved rods 26 are attached. Each rod 26 includes a curved portion 28 attached to upper support 18 and a straight portion 30 which is attached to lower support 22. The curve in portions 28 of rods 26 have a 3 inch diameter, and thus straight portions 26 are angled inwardly to where they attach to lower support 20. This makes the width of the preferred embodiment 24 inches at the top and 18 inches at the bottom. The height of the preferred embodiment is 11½ inches high in the middle and 14 inches high at curved portions 28.

Leg assembly 12 includes leg rods 32 and 34 which each have one end connected to lower support 20. Leg rods 32 and 34 are bent so that their height above the floor of the stove and fireplace is lower than the level of grate 60 as shown in FIG. 2. Also, the ends of rods 32 and 34 opposite lower support 20 rest on the floor when front member 10 is vertical. Leg assembly 12 also includes brace 36 which is attached to, and thus stabilizes, the ends of leg rods 32 and 34 away from lower support 20. In the preferred embodiment, leg rods 32 and 34 are 10¼ inches long and separated by 14 inches.

Handle 14 includes rods 38 and 40. Portions 42 and 44 of rods 38 and 40, respectively, are parallel and separated by 12 inches in the preferred embodiment. Portions 46 and 48 extend inwardly along the same line. Portions 50 and 52 are parallel and separated by a distance of 5 inches. Portions 50 and 52 include bends to form a grip 54. Cross support 56 interconnects handle rods 38 and 40 and extends beyond portions 50 and 52. When handle 14 is connected to front member 10, cross support 56 lies at the same level as lower supporting member 20. Since rods 38 and 40 are spaced widely at portions 42 and 44 where they connect to the front member 10 and cross support 56 is longer than the distance between portions 50 and 52, handle 14 provides stability for the present invention when handle 14 is connected to front member 10.

Handle 14 is removably connected to front member 10 by means of sleeves 58 which are attached to upper support 18. In the preferred embodiment, sleeves 58 are ¾ inch in diameter and are attached to upper support 18 three inches from each end.

In the preferred embodiment, all of the members, except for sleeves 58, are ½ inch diameter rods and made of 10×10 or 10×12 hard round steel. The various members are interconnected by welding.

When the present invention is used in connection with a fireplace or a stove, grate 60 is first loaded with logs. Grip 54 of handles 14 are then grasped and portions 42 and 44 are inserted in sleeves 58. The present invention is then slid into the fireplace or stove under grate 60. Handle 14 may then remain in position to provide additional support, or handle 14 may be removed to enable the screen or door of the fireplace or stove to be closed.

To add more fuel to the fire, handle 14 is reinserted in sleeves 58 and the invention is withdrawn from the fireplace or stove. After reloading, the present invention is returned to its original position.

When the present invention is not being used as a fire dog, it may be placed outside the fireplace or stove and wood may be stored on legs 32 and 34.

Thus, the shape of vertical members 16 aids in the even burning of the fire, since they assist in distributing heat. Also, the shape of vertical members 16 assist in preventing the hot coals from collapsing so that the wood burns evenly until it is entirely consumed. Curve 28 and inwardly sloping portions 30 of rods 26 also help hold the hot coals up so that the wood does not burn out in the center. The fact that portions 42 and 44 of handle 14 are separated by a distance greater than that of grips 54, and cross support 56 extends beyond portions 38 and 40 of handle 14 increases the stability of the present invention when handle 14 is left in sleeves 58.

Although only one exemplary embodiment of this invention has been described in detail above, those skilled in the art will readily appreciate that many modifications are possible in the exemplary embodiment without materially departing from the novel teachings and advantages of this invention. For example, it will be readily appreciated by those skilled in the art that the dimensions of this invention can be modified to adjust for the size of the fireplace or stove, and the size of the logs to be employed.

Accordingly, all such modifications are intended to be included within the scope of the invention as defined in the following claims.

What is claimed is:

1. A fire dog for containing logs burning on a grate comprising:

a front member having a generally planar extent vertically disposed, said front member comprising a plurality of vertical members, upper and lower support members, said vertical members being attached between said upper and lower support members in a spaced relation, and two interconnecting members, each connected from an end of said upper support to a corresponding end of said lower support, each of said interconnecting members curving upwardly from said upper support member;

a leg assembly attached to said front member and adapted to slide under said grate, said leg assembly having a length and weight to keep said front member vertically disposed when said logs are resting against said front member; and handle means removably connected to said front member for sliding said front member and leg assembly away from said grate while fire is burning on said grate.

2. A firedog as in claim 1 wherein said handle means extend downwardly at an angle from said front member to a level similar to the lower level of said front member for maintaining said front member vertical.

3. A fire dog as in claim 1 wherein said leg assembly includes elongated first and second leg members.

4. A fire dog for containing logs burning on a grate comprising:

a plurality of vertical members;

upper and lower support members, said vertical members being attached between said upper and lower support members in a spaced relationship;

two interconnecting members, each connected from an end of said upper support to a corresponding end of said lower support, each of said interconnecting members curving upwardly from said upper support member, said vertical members, support members and interconnecting members forming a front member;

a leg assembly including elongated first and second leg members having one end attached to said front member to maintain said front member vertical, said leg assembly having a length and a weight to keep said front member vertical when said logs are resting against said front member; and handle means removably connected to said upper support member and extending downwardly at an angle from said front member to a level similar to said lower support member for sliding said front member and leg members away from said grate while a fire is burning on said grate and maintaining said front member vertical.

5. A fire dog as in claim 4 wherein said first and second leg members have one end thereof attached to said lower support member, and said leg assembly further comprises a brace attached between the second ends of said first and second leg members.

6. A fire dog as in claim 1 or 4 wherein said handle means comprises:

first and second rods extending downwardly from said upper support member at an angle to said front member, said first and second rods each having first, second and third portions disposed consecutively therealong, said first portions being relatively parallel to each other, said second portions extending inwardly with respect to each corresponding first portion and said third portions being parallel and spaced from each other a distance suitable to be grasped; and a cross support attached between the ends of said third portions opposite said second portions.

7. A fire dog as in claim 1 or 4 wherein each of said vertical members has a straight portion attached to said upper support and a curved portion attached to said lower support, said curved portion extending inwardly from the plane defined by said straight portions.

8. A fire dog as in claim 6 further comprising first and second sockets attached to said upper support members, said sockets being adapted to receive the ends of said first portions opposite said second portions.

9. A fire dog for containing logs burning on a grate comprising:

a front member having a generally planar extent vertically disposed;

a leg assembly attached to said front member and adapted to slide under said grate, said leg assembly having a length and weight to keep said front member vertically disposed when said logs are resting against said front member; and handle means removably connected to said front member for sliding said front member and leg assembly away from said grate while a fire is burning on said grate, said handle means comprising first and second rods extending downwardly from said front member at an angle to said front member, said first and second rods each having first, second and third portions disposed consecutively therealong, said first portions being relatively parallel to each other, said second portions extending inwardly with respect to each corresponding first portion and said third portions being parallel and spaced from each other a distance suitable to be grasped, and a cross support attached between the ends of said third portions opposite said second portions.

* * * * *